US005526839A

United States Patent [19]

Padron

[11] Patent Number: 5,526,839

[45] Date of Patent: Jun. 18, 1996

[54] STABLE EMULSION OF VISCOUS CRUDE HYDROCARBON IN AQUEOUS BUFFER SOLUTION AND METHOD FOR FORMING AND TRANSPORTING SAME

[75] Inventor: Aaron Padron, Qta Mi Negrita, Venezuela

[73] Assignee: Maraven, S.A., Caracas, Venezuela

[21] Appl. No.: 6,779

[22] Filed: Jan. 21, 1993

[51] Int. Cl.[6] ..... F17D 1/17

[52] U.S. Cl. ..... 137/13; 252/312

[58] Field of Search ..... 137/13; 252/312

[56] References Cited

U.S. PATENT DOCUMENTS

| | | | |
|---|---|---|---|
| 3,487,844 | 1/1970 | Simon et al. | 137/13 |
| 4,343,323 | 8/1982 | Kessick et al. | 137/13 |

FOREIGN PATENT DOCUMENTS

| | | | |
|---|---|---|---|
| 2835664 | 2/1979 | Germany | 137/13 |

OTHER PUBLICATIONS

Horace G. Deming, *Fundamental Chemistry,* 464–67 (2d ed., New York, John Wiley & Sons, 1947).

*Primary Examiner*—Gerald A. Michalsky
*Attorney, Agent, or Firm*—Bachman & LaPointe

[57] ABSTRACT

The method for forming a stable emulsion of a viscous crude hydrocarbon in an aqueous buffer solution, includes the steps of: providing a viscous crude hydrocarbon containing an inactive natural surfactant and having a salt content by weight of less than or equal to about 1.0% and having a total acid number of greater than or equal to about 1, preferably greater than or equal to about 2.5; forming a solution of a buffer additive in an aqueous solution to provide a basic aqueous buffer solution, the buffer additive being operative to extract and activate the inactive natural surfactant from the viscous crude hydrocarbon; and mixing the viscous crude hydrocarbon with the aqueous buffer solution at a rate sufficient to provide an emulsion of the viscous crude hydrocarbon in the aqueous buffer solution, whereby the buffer additive extracts the inactive natural surfactant from the viscous crude hydrocarbon and activates the inactive natural surfactant so as to stabilize the emulsion. The inactive natural surfactants are preferably carboxylic acids. The buffer additive is preferably selected from the group consisting of (a) sodium hydroxide in combination with sodium bicarbonate and (b) sodium silicate. A method for transporting the emulsion is also disclosed.

2 Claims, 5 Drawing Sheets

STABLE EMULSION OF VISCOUS CRUDE HYDROCARBON IN AQUEOUS BUFFER SOLUTION AND METHOD FOR FORMING AND TRANSPORTING SAME

BACKGROUND OF THE INVENTION

The invention relates to an emulsion and a method for forming an emulsion of a viscous crude hydrocarbon in an aqueous buffer solution.

Large reserves of crude hydrocarbons exist which, in their natural state, are very viscous. These hydrocarbons are capable of being processed into useful end products. However, the viscous nature of such viscous crude hydrocarbons makes it difficult to transport the hydrocarbons in conventional pipelines to stations where the viscous crude hydrocarbons can be treated. Typical viscous crude hydrocarbons may be characterized by the following chemical and physical properties: C wt. % of 78.2 to 85.5; H wt. % of 9.0 to 10.8; O wt. % of 0.26 to 1.1; N wt. % of 0.50 to 0.70; S wt. % of 2.00 to 4.50; Ash wt. % of 0.05 to 0.33; Vanadium, ppm of 50 to 1,000; Nickel, ppm of 20 to 500; Iron, ppm of 5 to 100; Sodium, ppm of 10 to 500; Gravity, API of 1.0 to 16.0; Viscosity (cST), 122° F. of 100 to 5,000,000; Viscosity (cST), 210° F. of 10 to 16,000; LHV (BTU/LB) of 15,000 to 19,000; and Asphaltenes, wt. % of 5.0 to 25.0.

From a consideration of the above, particularly the viscosity, the difficulties in transporting a material in conventional pipelines can be appreciated.

One solution to the problem of transporting viscous crude hydrocarbons has been to form emulsions of the hydrocarbon in water. Such emulsions exhibit greatly reduced viscosity which, of course, facilitates the transport of same. Unfortunately, such emulsions require emulsifiers to be stable, and commercial emulsifiers conventionally used in forming such an emulsion are expensive. The added cost of the commercial surfactant naturally makes the option of forming emulsions to transport viscous crude hydrocarbons less attractive.

It is desirable to provide an emulsion of the viscous crude hydrocarbon in water which does not require commercial surfactants/emulsifiers for stability. Such an emulsion would provide an economical method for transporting the viscous crude hydrocarbon and, therefore, a more economical method for processing the viscous crude hydrocarbon into useful end products.

Accordingly, it is the principal object of the present invention to provide a transportable stable emulsion of a viscous crude hydrocarbon in water which does not require commercial emulsifiers for stability.

It is a further object of the invention to provide such an emulsion which is easily broken once it is transported to the desired destination.

It is a still further object of the invention to provide such an emulsion having two distinct droplet size populations, and, therefore, improved viscosity characteristics.

It is another object of the invention to provide a method for forming such an emulsion.

Other objects and advantages will appear hereinbelow.

SUMMARY OF THE INVENTION

The invention relates to a stable emulsion of a viscous crude hydrocarbon in an aqueous buffer solution, as well as a method for forming such an emulsion without using commercial emulsifiers for stability.

According to the invention, the stable emulsion is formed by a method including the steps of: providing a viscous crude hydrocarbon containing an inactive natural surfactant and having a salt content by weight of less than or equal to about 1.0% with respect to the emulsion continuous phase and having a total acid number of greater than or equal to about 1, preferably greater than or equal to about 2.5; forming a solution of a buffer additive in an aqueous solution to provide a basic aqueous buffer solution, the buffer additive being operative to extract and activate the inactive natural surfactant from the viscous crude hydrocarbon; and mixing the viscous crude hydrocarbon with the aqueous buffer solution at a rate sufficient to provide an emulsion of the viscous crude hydrocarbon in the aqueous buffer solution, whereby the buffer additive extracts the inactive natural surfactant from the viscous crude hydrocarbon and activates the inactive natural surfactant so as to stabilize the emulsion.

The buffer additive is preferably either sodium bicarbonate with sodium hydroxide, or sodium silicate.

The buffer additive may be added at a concentration of 8,000 ppm or more so as to provide a bimodal emulsion having improved viscosity characteristics.

BRIEF DESCRIPTION OF THE DRAWINGS

A detailed description of preferred embodiments of the invention follows, with reference to the accompanying drawings, wherein.

DETAILED DESCRIPTION

Figure 1:
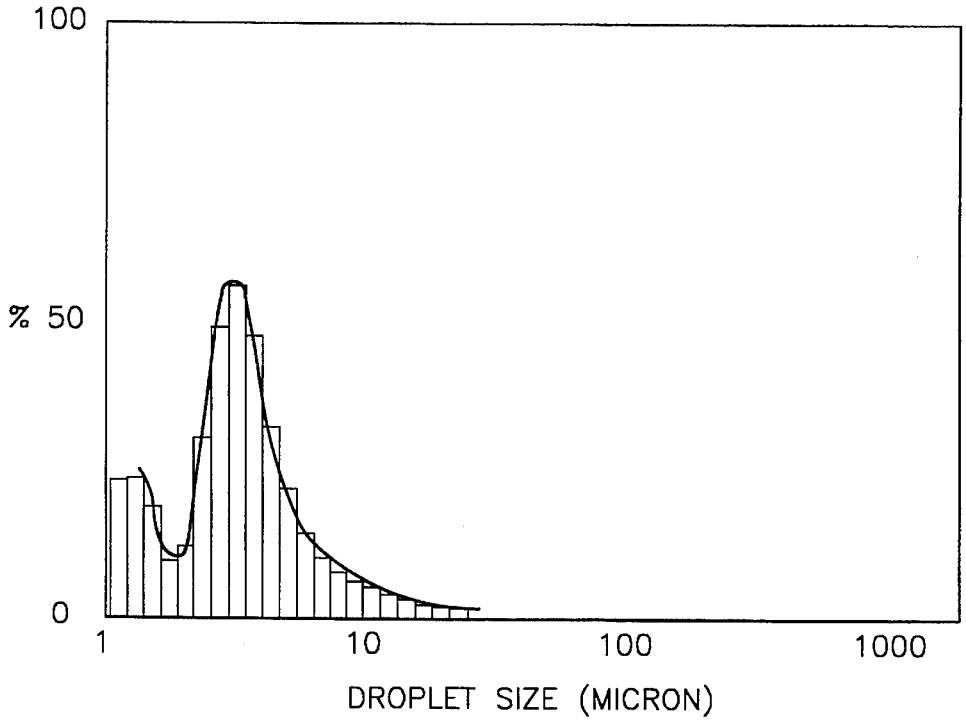
FIGS. 1 and 2 are graphs showing the droplet size distribution of emulsion formed according to the invention.

The invention relates to a stable emulsion of a viscous crude hydrocarbon in a basic aqueous buffer solution which is prepared without commercial surfactants.

Viscous crude hydrocarbons are difficult to transport in conventional pipelines due to the high viscosity of the hydrocarbon. This difficulty has been addressed by the formation of hydrocarbon-in-water emulsions wherein commercial emulsifiers are used to stabilize the emulsion. Emulsions such as this have greatly reduced viscosity as compared to the original hydrocarbon, and are therefore easily transported through pipelines.

Conventionally formed emulsions, however, as set forth above, require costly commercial emulsifiers for stability.

According to the invention, viscous crude hydrocarbons are emulsified for transport without using commercial emulsifiers. Rather, the emulsions are formed by activating materials naturally contained in the viscous crude hydrocarbons. These materials are referred to herein as inactive surfactants which, when activated, are natural surfactants.

The term viscous crude hydrocarbon refers generally to any viscous crude oil or bitumen which, when produced, is too viscous for practical pipeline flow. A typical viscous crude hydrocarbon may be characterized as follows: C wt. % of 78.2 to 85.5; H wt. % of 9.0 to 10.8; O wt. % of 0.26 to 1.1; N wt. % of 0.50 to 0.70; S wt. % of 2.00 to 4.50; Ash wt. % of 0.05 to 0.33; Vanadium, ppm of 50 to 1,000; Nickel, ppm of 20 to 500; Iron, ppm of 5 to 100; Sodium, ppm of 10 to 500; Gravity, API of 1.0 to 16.0; Viscosity (cST), 122°

F. of 100 to 5,000,000; Viscosity (cST), 210° F. of 10 to 16,000; LHV (BTU/LB) of 15,000 to 19,000; and Asphaltenes, wt. % of 5.0 to 25.0.

Furthermore, according to the invention, the viscous crude hydrocarbon has a salt content, by weight with respect to the emulsion continuous phase, of less than or equal to about 1.0%, a total acid number of greater than or equal to about 1, preferably greater than or equal to about 2.5, an API gravity of less than 16 and a viscosity at ambient temperature of between about 10,000 cp to about 500,000 cp.

The total acid number (TAN) refers to the volume, in cc's, of N/10 potassium hydroxide which are necessary to neutralize one gram of the viscous crude hydrocarbon. Thus, a TAN of 1 means that the hydrocarbon is such that 1 cc of N/10 KOH will neutralize one gram of the hydrocarbon.

Most hydrocarbons in their natural state contain inactive potential surfactant materials. It is the object of the invention to extract these inactive surfactants from the hydrocarbon and activate the inactive surfactant so as to emulsify the viscous crude hydrocarbon in water and stabilize the emulsion. The emulsion so formed is then easily transportable to facilities for processing as desired. The inactive potential surfactants which are activated, according to the present invention, are acids which are saponifiable and which act as surfactants in their dehydrogenated form. Such acids may contain, for example, carboxylic acid groups and phenol groups.

According to the invention, the potential surfactants are extracted and activated by a buffer additive which is added to the emulsion water to form a basic aqueous buffer solution. The basic nature of the solution is apparently necessary for the activation of the inactive surfactants, and the buffering helps to maintain the basic pH despite conditions to which the emulsion may be subjected which would normally cause the pH to fluctuate and which would, therefore, destabilize the emulsion.

According to the invention, the buffer additive is preferably either sodium bicarbonate with sodium hydroxide, or sodium silicate. The function of the buffer additive is to raise the pH of the aqueous buffer solution to provide a basic aqueous buffer solution, to extract the inactive surfactants from the hydrocarbon, and to activate the surfactant by saponifying or dehydrogenating the inactive surfactant so as to provide an active natural surfactant for stabilizing the emulsion.

According to the invention, the emulsion is formed as follows. Basic aqueous buffer solution is formed by adding the buffer additive to water at a concentration of equal to or greater than about 1,500 ppm, and preferably less than or equal to about 15,000 ppm. Preferably, buffer additive is added in amounts sufficient to provide a pH of the basic aqueous buffer solution between about 9 to about 11.

The aqueous buffer solution is then mixed with the viscous crude hydrocarbon at a mixing rate sufficient to provide an emulsion of the hydrocarbon in the buffer solution having desired viscosity and droplet size characteristics.

The hydrocarbon and buffer solution are preferably mixed at a ratio, by weight, of hydrocarbon to buffer solution of at least about 50:50, preferably 60:40 and more preferably 70:30.

The mixing step is preferably carried out at a mixing rate of greater than or equal to about 800 rpm so as to provide an emulsion having viscosity at room temperature of less than or equal to about 2,000 cp, and having an average droplet diameter of greater than or equal to about 3 μm, preferably greater than or equal to about 50 μm. This droplet size makes it easier to break the emulsion which, as mentioned above, is desirable after the emulsion has been transported to treatment facilities. Such emulsions are typically broken so as to reform an emulsion according to more refined parameters for various end uses such as combustible fuels and the like.

When the buffer additive is sodium bicarbonate, sodium hydroxide is added to the solution in amounts sufficient to provide the desired basic pH, preferably between about 9 to about 11 as described above. Sodium bicarbonate is added at the aforedescribed concentration of between about 1,500 ppm to about 15,000 ppm to buffer the basic solution and to provide the means for extracting and activating the inactive surfactant of the hydrocarbon when the emulsion is mixed.

When the buffer additive is sodium silicate, the proper pH is provided by manipulating the molar ratio in the sodium silicate of $Na_2O$ to $SiO_2$. Providing a molar ratio of $Na_2O$ to $SiO_2$ of greater than or equal to about 2.1 will provide a pH of the buffer solution of between about 9 to about 11 when the buffer additive is provided at a concentration in the solution of between about 1,500 ppm to about 15,000 ppm.

It should be noted that the emulsion of the present invention may be formed at any convenient and desirable location along the production path of the viscous crude hydrocarbon. It is known, for example, to form such emulsions downhole, or at the well head, or at collecting stations serving multiple wells. Naturally, due to the highly viscous nature of the hydrocarbon, it is preferable to form the emulsion as soon as possible so as to take maximum advantage of the improved viscosity of the emulsion.

According to a preferred embodiment of the invention, bimodal emulsions may be formed having further improved viscosity characteristics. A bimodal emulsion is an emulsion where the droplets of the dispersed phase have two distinct average droplet diameter populations. It has been found that such an emulsion can be provided, according to the invention, by utilizing a concentration of buffer additive in the aqueous buffer solution of at least about 8,000 ppm. Such a bimodal emulsion preferably has a small droplet size population having an average droplet size of up to about 4 microns, and a large droplet size population having an average droplet size of between about 4 microns to about 20 microns. As demonstrated in the examples below, such a bimodal emulsion has significantly improved viscosity characteristics as compared to a monomodal emulsion having a single average droplet size corresponding to the average droplet size of the bimodal emulsion.

Emulsion formed according to the invention is easily transportable due to the reduced viscosity of the emulsion and is provided without the cost of commercial emulsifiers.

According to the invention, such an emulsion may preferably be transported as follows. In a conventional pipeline system, the emulsion is preferably preceded and followed by a plug of additional basic aqueous buffer solution which may be provided in the same manner as the basic aqueous buffer solution of the emulsion, or which may be any other conveniently provided basic aqueous buffer solution. It is noted, for example, that it is not necessary to use the buffer additive of the present invention in formulating the plugs of additional basic aqueous buffer solution since the plugs are not to be emulsified with the hydrocarbon and therefore do not need to extract and activate the natural inactive surfactants contained therein. Thus, any convenient additive may be used to provide the additional basic aqueous buffer solution. According to the invention, a first volume or plug of the additional basic aqueous buffer solution is pumped through the pipeline, which is followed by the emulsion to be transported, which is in turn followed by a second volume or plug of the additional basic aqueous buffer solution.

Preferably, the first and second volumes of additional basic aqueous buffer solution are equal to the volume of a length of about 4.0 km of the pipeline through which the emulsion is to be transported.

EXAMPLE 1

This example demonstrates the relation between mixing rate and stability of the emulsion formed according to the present invention.

A Zuata crude was provided having the following characteristics: Density at 15° C., 1.005 kg/l; API gravity at 60° F., 9.3; kinetic viscosity at 100° F., 11,936 cST; kinetic viscosity at 140° F., 1,654 cST; and Sulphur content, % M/M, of 3.35.

Buffer additive was used at a concentration of 10,000 ppm. Emulsions were prepared at a ratio by weight of hydrocarbon to buffer solution of 60:40. These emulsions were prepared at varying mixing rates, and the droplet diameter of the emulsions formed was monitored over time. Tables 1 and 2 below present the data obtained for emulsions prepared with sodium hydroxide/sodium bicarbonate and with sodium silicate, respectively.

TABLE 1

| Days | 600 RPM µm | 800 RPM µm | 1,000 RPM µm | 1,300 RPM µm |
|---|---|---|---|---|
| 1 | 83 | 54 | 48 | 35 |
| 3 | 95 | 60 | 47 | 40 |
| 5 | >100 | 62 | 49 | 40 |
| 7 | Big Flocs | 63 | 50 | 42 |
| 9 | | 60 | 48 | 39 |

Table 1 shows that emulsions formed using sodium hydroxide and 10,000 ppm sodium bicarbonate were stable when mixed at 800 rpm or higher. Emulsion formed at 600 rpm was unstable.

TABLE 2

| Days | 600 RPM µm | 800 RPM µm | 1,000 RPM µm | 1,300 RPM µm |
|---|---|---|---|---|
| 1 | 100 | 100 | 85 | 78 |
| 3 | 100 | 100 | 98 | 83 |
| 5 | Flocs | 100 | 100 | 85 |
| 7 | | 100 | 100 | 81 |
| 9 | | 100 | 100 | 89 |

Table 2 indicates, similar to Table 1, that 10,000 ppm sodium silicate provides stable emulsions at 800 rpm and higher.

EXAMPLE 2

This example demonstrates the relation between buffer additive concentration and emulsion stability.

Emulsions were formed using varying concentrations of sodium silicate and using the same crude as in Example 1, at a ratio of crude to buffer solution of 60:40. The emulsions were mixed at 800 rpm, and viscosity was measured over time. Table 3 below contains the data so obtained.

TABLE 3

| Buffer Concentration PPM | Viscosity MPA-SEC | Stability Days |
|---|---|---|
| 1,000 | unmeasurable | 0.13 |
| 1,300 | 78 | 0.83 |
| 1,500 | 73 | >6 |
| 1,650 | 72 | >6 |
| 1,800 | 90 | >6 |
| 2,000 | 94 | >6 |

As shown, emulsions formed using less than 1,500 ppm buffer additive were very unstable and broke within a 24 hour period. At 1,500 ppm and higher, emulsions were provided which were stable for at least 6 days.

EXAMPLE 3

Emulsions were formed as in Example 2, having ratios of crude to buffer solution of 60:40 and 70:30, at varying concentrations of sodium silicate. Both viscosity and average droplet diameter were monitored. Tables 4 and 5 below contain data obtained at ratios of 60:40 and 70:30 respectively.

TABLE 4

RATIO - 60:40

| Buffer Concentration PPM | Viscosity MPA-SEC | Average Droplet Diameter µm |
|---|---|---|
| 2,000 | 38.55 | 67.08 |
| 4,000 | 47.12 | 25.89 |
| 6,000 | 169.6 | 6.76 |
| 8,000 | 292.4 | 2.95 |
| 10,000 | 125.4 | 2.28 |

TABLE 5

RATIO - 70:30

| Buffer Concentration PPM | Viscosity MPA-SEC | Average Droplet Diameter µm |
|---|---|---|
| 2,000 | 324.2 | 48.12 |
| 4,000 | 574.2 | 8.47 |
| 6,000 | 1236 | 2.75 |
| 8,000 | 1341 | 1.03 |
| 10,000 | 762.2 | 1.11 |

Figure 2:
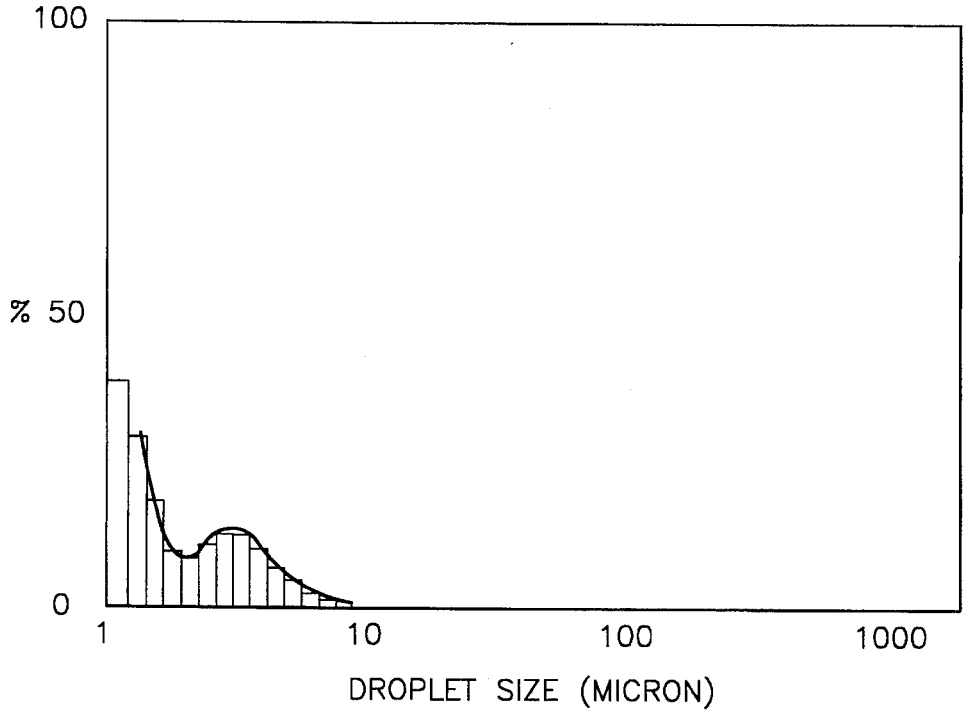

At both ratios, average droplet diameter decreased as the concentration of buffer additive was increased. Further, up to 8,000 ppm, viscosity increased as the concentration of buffer additive was increased. Above 8,000 ppm, however, emulsions having both ratios indicated a decrease in viscosity. It was found that this decrease in viscosity was apparently caused by the formation of two distinct populations of droplets having different average droplet diameters, that is, bimodal emulsions were formed. FIG. 1 and 2 show the distribution of droplet size of the emulsion, the two distinct populations being indicated by the separate spikes or humps in the distribution.

EXAMPLE 4

This example demonstrates the stability of emulsions, formed according to the invention, during transport.

An emulsion was formed as in Example 1, using Zuata crude in buffer solution at a ratio of 60:40. The buffer additive was sodium silicate at a concentration of 1,600 ppm, the emulsion being mixed in a reciprocal pump.

A pipeline having a length of 55 km and a diameter of 6 inches was provided and equipped with temperature and pressure sensors along its length which were linked to a computer to gather data.

The emulsion was pumped back and forth along the pipeline for 16 days, each time being preceded and followed by a plug of buffer solution equal to about 4 km of the pipeline. The emulsion was pumped at different flow rates and the pressure monitored. Significant changes in pressure would indicate meaningful changes in viscosity. The data so obtained is set forth in Table 6.

TABLE 6

| Time Days | Flow Rate Barrels per Day | Pressure PSI |
|---|---|---|
| 1 | 7,424 | 880 |
| 2 | 7,118 | 860 |
| 3 | 5,228 | 530 |
| 4 | 5,528 | 540 |
| 5 | 7,278 | |
| 6 | 6,435 | |
| 7 | 6,336 | |
| 8 | 6,512 | 560 |
| 9 | | 600 |
| 10 | 5,490 | 600 |
| 11 | | |
| 12 | 5,217 | 390 |
| 13 | 5,140 | |
| 14 | 5,143 | 560 |
| 15 | | 640 |
| 16 | | 600 |

As shown, flowing the emulsion at rates of between about 5,000 to about 7,000 barrels per day for 16 days caused no significant variations in pumping pressure and, therefore, indicate a highly transportable emulsion.

EXAMPLE 5

This example further demonstrates the stability of emulsions of the present invention during transport and also during storage.

Figure 3:
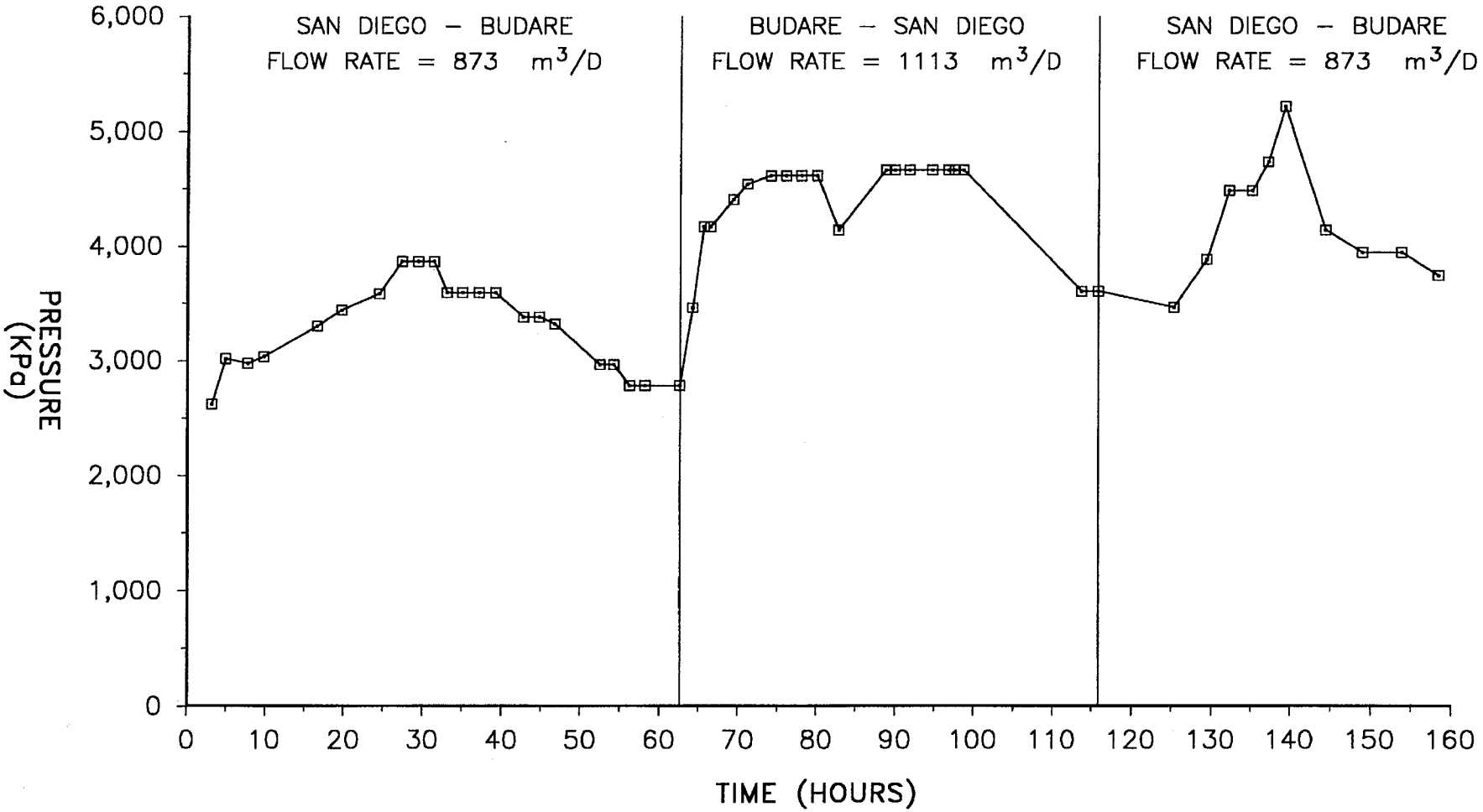
FIGS. 3 and 4 are graphs showing results of dynamic stability tests on an emulsion formed according to the invention.
Figure 4:
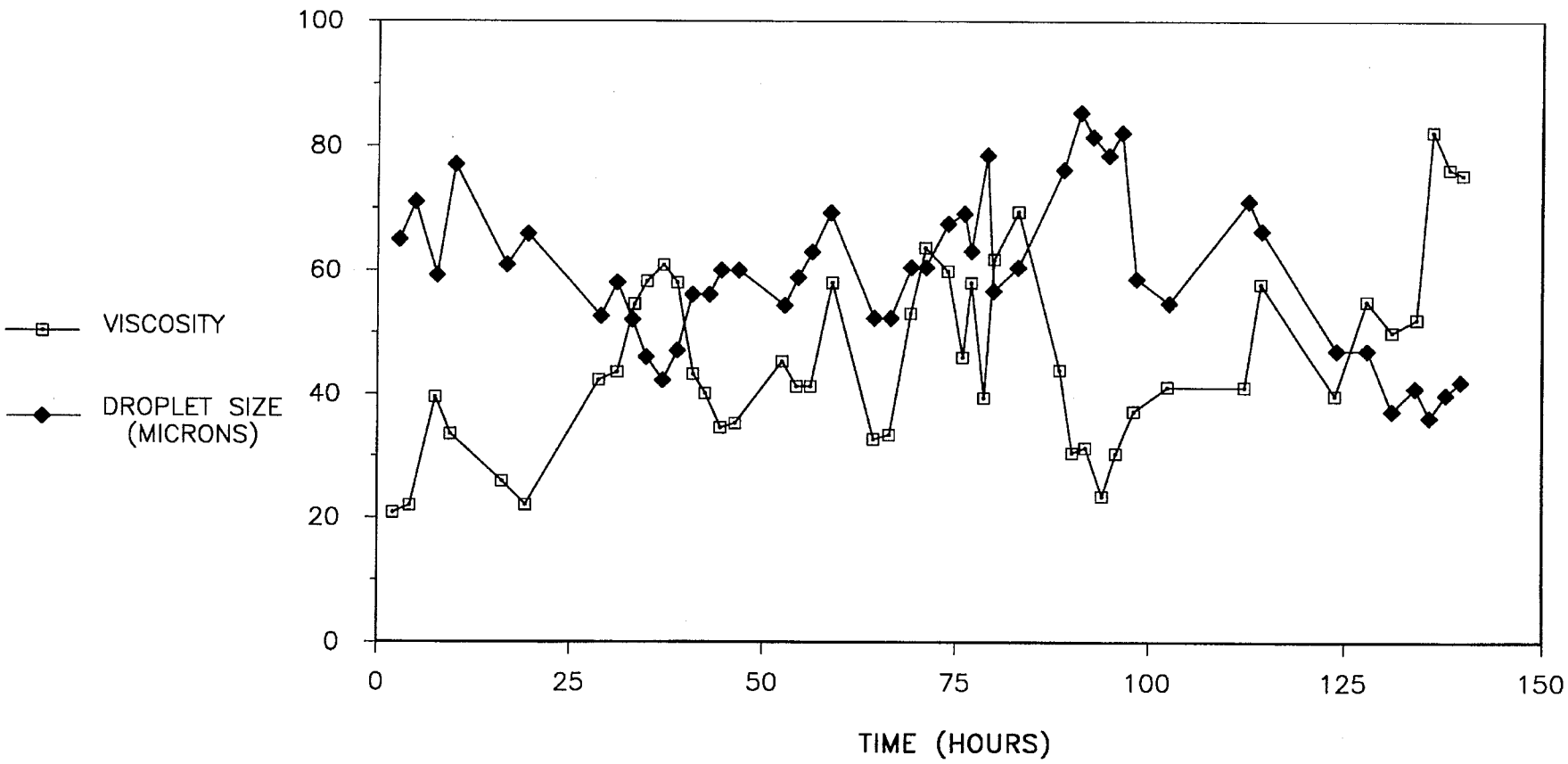

An emulsion was prepared as described in Example 4 above. The emulsion was pumped through a 55 km pipeline, having a 6 inch diameter, between station San Diego and station Budare. 1,440 $m^3$ of emulsion were preceded and followed in the pipeline by 4 km plugs of additional basic aqueous buffer solution. The emulsion was transported 3 times along the length of the pipeline, for a total of 165 km. The emulsion was tested every 2 hours during transportation. Oil to water ratio, droplet size, viscosity and pressure were measured. The results are shown in FIGS. 3 and 4. No significant variation was observed. The increased pressure in the Budare—San Diego leg was due to an increase in flow rate, and the pressure increase in the final leg of the transport was caused by a change in droplet size due to passing the emulsion through two reciprocating pumps, in series, located along the pipeline.

Figure 5:
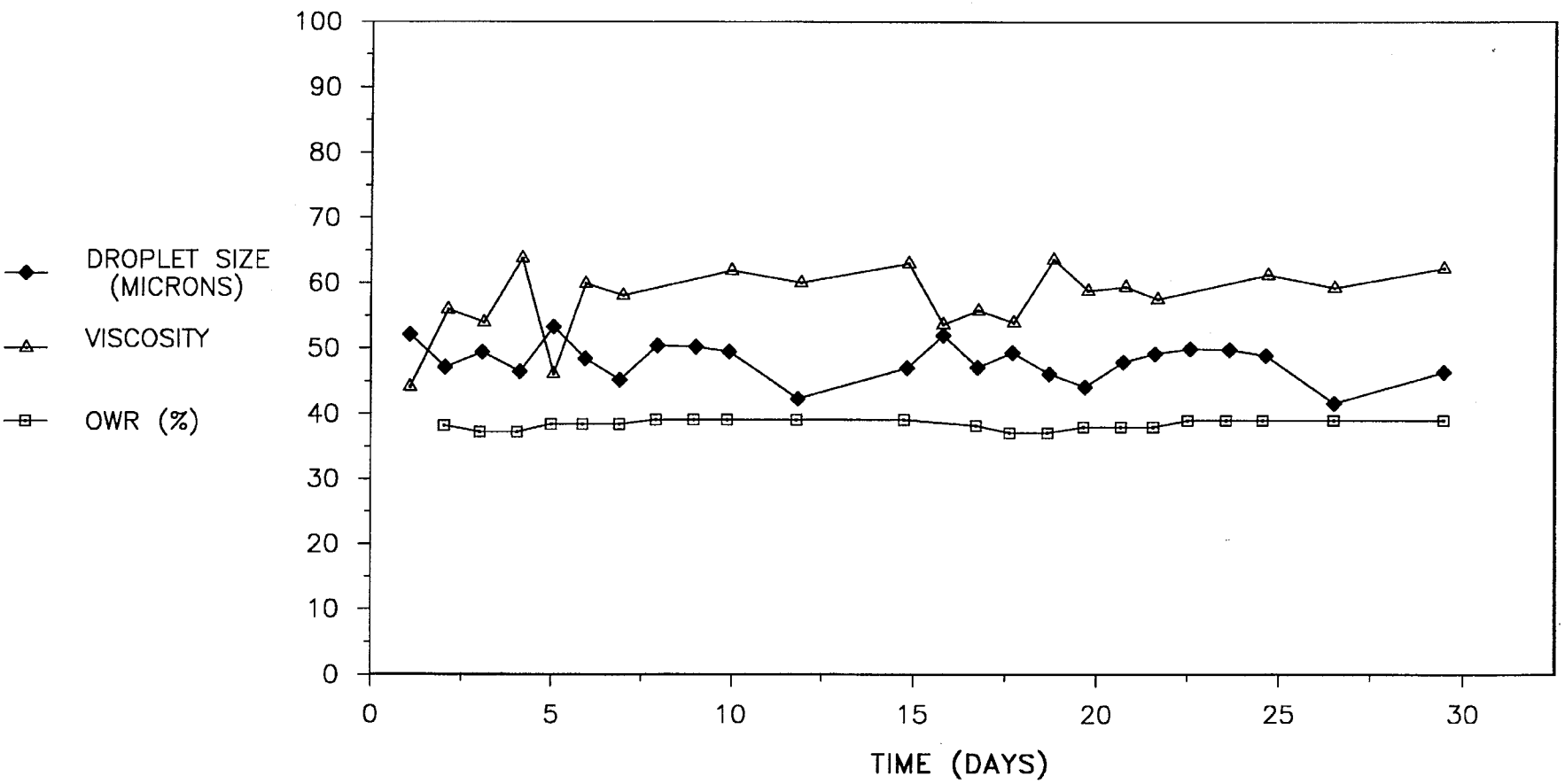
FIGS. 5 and 6 are graphs showing results of static stability tests on an emulsion formed according to the invention.
Figure 6:
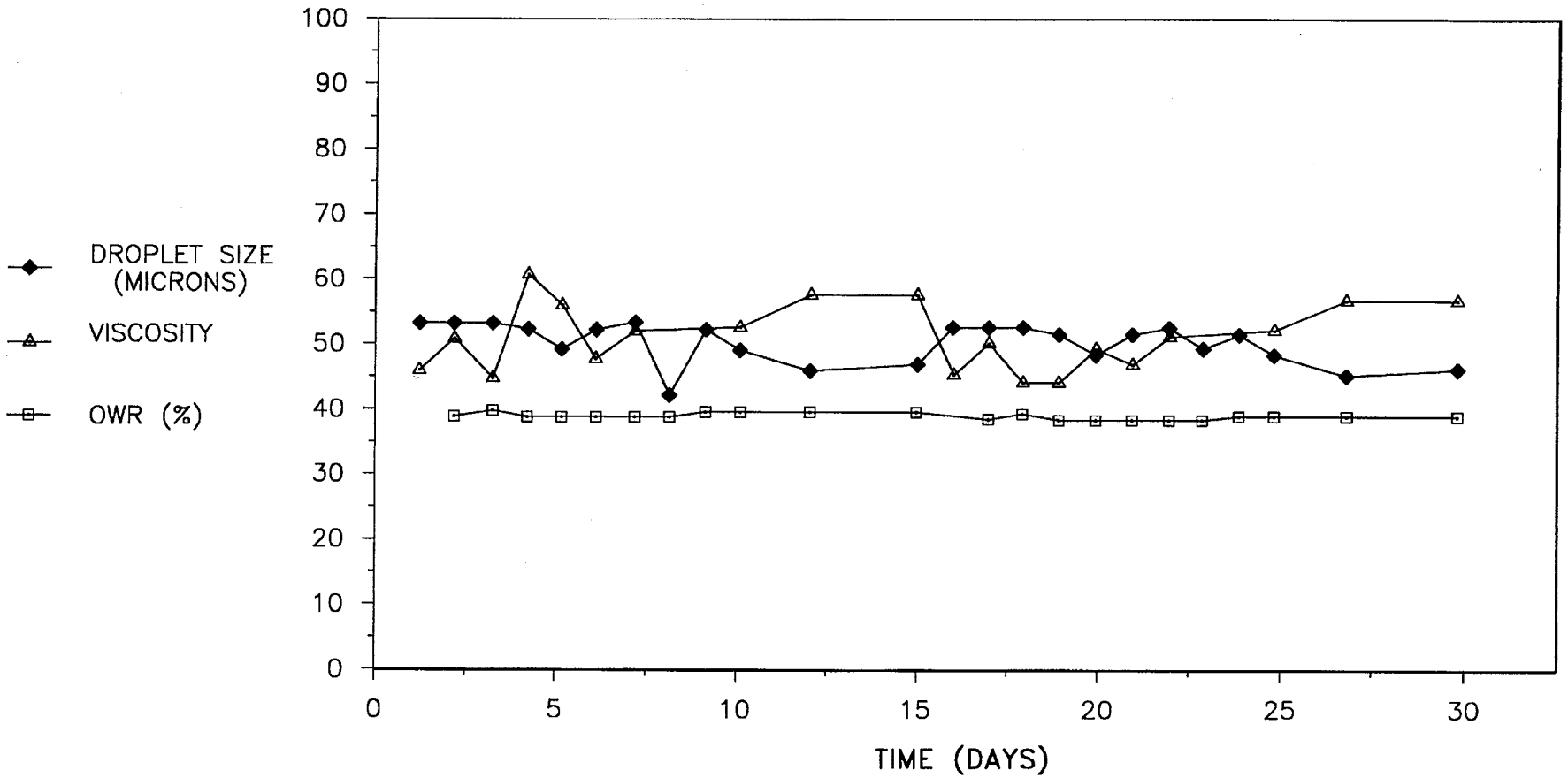

After transportation, the emulsion was stored in a 1,590 $m^3$ tank for a period of 30 days. Samples of the emulsion were taken periodically from the top and the bottom of the tank and measured for droplet size, viscosity, and oil to water ratio. FIGS. 5 and 6 reflect the data so obtained for the tank bottom and top respectively. As shown, the emulsion remained substantially unchanged in the tank for the period of 30 days, indicating an excellent stability.

The preceding examples indicate that emulsions formed according to the present invention, without commercial emulsifiers, provide an excellent vehicle for the transport of viscous crude hydrocarbons. Such emulsions are stable and have reduced viscosity greatly facilitating transport.

It is to be understood that the invention is not limited to the illustrations described herein, which are deemed to be merely illustrative of the best modes of carrying out the invention, and which are susceptible of modification of form, size, arrangement of parts and details of operation. The invention rater is intended to encompass all such modifications which are within its spirit and scope as defined by the claims.

What is claimed is:

1. A method for forming a stable emulsion of a viscous crude hydrocarbon in an aqueous buffer solution, comprising the steps of:

providing a viscous crude hydrocarbon containing an inactive natural surfactant and having a salt content by weight of less than or equal to about 1.0% and having a total acid number of greater than or equal to about 1;

forming a solution of a buffer additive comprising sodium silicate in an aqueous solution to provide a basic aqueous buffer solution mixing the sodium silicate at a concentration in the aqueous buffer solution of between about 1,500 ppm to about 15,000 ppm, the sodium silicate being provided having a molar ratio of $Na_2O$ to $SiO_2$ of greater than or equal to about 2.1 so as to provide a pH of the aqueous buffer solution of between about 9 to about 11, the buffer additive being operative to extract and activate the inactive natural surfactant from the viscous crude hydrocarbon; and mixing the viscous crude hydrocarbon with the aqueous buffer solution at a rate sufficient to provide an emulsion of the viscous crude hydrocarbon in the aqueous buffer solution, whereby the buffer additive extracts the inactive natural surfactant from the viscous crude hydrocarbon and activates the inactive natural surfactant so as to stabilize the emulsion.

2. A viscous crude hydrocarbon-in-aqueous buffer solution emulsion, comprising:

a viscous crude hydrocarbon discontinuous phase having a salt content by weight of less than or equal to about 1.0% and having a total acid number of greater than or equal to about 1; and a basic aqueous buffer solution continuous phase containing a buffer additive comprising sodium silicate and a natural surfactant wherein the sodium silicate has a molar ratio of $Na_2O$ to $SiO_2$ of greater than or equal to about 2.1 so as to provide the aqueous buffer solution with a pH of between about 9 to about 11, the sodium silicate having a concentration of between about 1500 ppm to about 15,000 ppm, the natural surfactant being an inactive surfactant naturally contained in the viscous crude hydrocarbon which inactive surfactant is extracted and activated by the buffer additive so as to stabilize the viscous crude hydrocarbon-in-aqueous buffer solution emulsion.

* * * * *